United States Patent [19]

Slatter

[11] Patent Number: 4,971,622

[45] Date of Patent: Nov. 20, 1990

[54] SULPHUR AND SILICON CONTROL IN FERROCHROMIUM PRODUCTION

[75] Inventor: Donovan D. Slatter, Krugersdorp, South Africa

[73] Assignee: Middelburg Steel and Alloys (Proprietary) Limited, Transvaal Provence, South Africa

[21] Appl. No.: 293,368

[22] Filed: Jan. 4, 1989

[30] Foreign Application Priority Data

Jan. 5, 1988 [ZA] South Africa ..... 87/8300

[51] Int. Cl.[5] ..... C22B 4/00

[52] U.S. Cl. ..... 75/561; 75/10.58; 75/10.61

[58] Field of Search ..... 75/10.58, 58

[56] References Cited

U.S. PATENT DOCUMENTS

| | | | |
|---|---|---|---|
| 2,098,176 | 11/1937 | Udy | 75/10.58 |
| 3,865,574 | 2/1975 | Long | 75/4 |
| 4,391,633 | 7/1983 | Yamauchi | 75/58 |
| 4,450,004 | 5/1984 | Matsuo | 75/58 |
| 4,560,406 | 12/1985 | Ikehara | 75/58 |
| 4,790,872 | 12/1988 | Bowman | 75/10.58 |

*Primary Examiner*—Peter D. Rosenberg
*Attorney, Agent, or Firm*—Frost & Jacobs

[57] ABSTRACT

A method for sulphur and silicon control in the production of ferrochromium is characterized by controlling the reducing conditions in a melting furnace into which have been fed the highly pre-reduced products of a reduction smelter and by adjusting the CaO content of the final slag.

8 Claims, No Drawings

SULPHUR AND SILICON CONTROL IN FERROCHROMIUM PRODUCTION

FIELD OF THE INVENTION

THIS INVENTION relates mainly to the desulphurisation of ferrochromium which has been produced by way of an initial solid-state or semi-fused state pre-reduction of chromite ores using a solid reductant such as coal. More particularly it is concerned with an ore product which has been reduced to such a high degree that subsequent treatment to separate the metallic ferrochromium from the slag forming components is essentially a matter of melting only as opposed to the smelting reduction required for chromite ores which are less completely reduced or which are still unreduced.

A further effect is that the desulphurisation process here disclosed provides also a means of controlling the silicon content of the ferrochromium.

BACKGROUND TO THE INVENTION

In the field of ferrochromium production, pre-reduction of chromite ores prior to final smelting in electric furnaces is becoming of increasing importance in order to decrease the use of costly electrical energy.

Rotary kilns or rotary hearths are typically used for this pre-reduction process, with the heat requirements being supplied by combustion of coal, gas or oil and the reduction of the ore by coal, char or coke. In the typical existing processes, finely ground chromite ore is pelletised together with coke and fed with an excess of coal to a rotary kiln operating at temperatures of up to 1450° C. These processes do not achieve complete reduction of the chromite and the partly-reduced pellets are then charged to an electric submerged arc furnace for final smelting reduction and separation of molten ferrochromium from the slag.

In a more recent process, described in West German Patent DE No. 3347/686 CI to Fried. Krupp GmbH, chromite ore fines are fed directly to a rotary kiln together with excess coal and appropriate fluxes, and treated at temperatures up to and exceeding 1500 C. A nearly completely reduced product results (more than 90% metallisation of the chromium and nearly 100% metallisation of the iron present). This product is suitable for charging directly to a melting unit, such as, for example, an electric arc furnace, to separate the ferrochromium from the slag, thereby avoiding the usual reduction smelting operation.

All of these pre-reduction processes tend to result in high sulphur contents in the metallic fraction (typically 0,25% S) due to the use of large amounts of coal or coke, which partly replace the electrical energy requirements in addition to providing the reductant for the necessary chemical reactions. These carbonaceous materials are the main source of sulphur in ferrochromium production. Sulphur is a deleterious impurity in steels and as ferrochromium is a basic ingredient of chromium-containing steels, such as stainless steels, strict limits are placed upon the maximum contents of sulphur in ferrochromium. Typical upper limits range from 0,03% S to 0,05% S.

According to the Krupp patent already referred to, desulphurisation can be carried out by injecting lime or calcium carbide into the pre-reduced ferrochromium after it has been melted in a suitable furnace. It is claimed that by this means the sulphur content of the ferrochromium can be lowered to less than 0,01%. Although it is well known that both lime and calcium carbide are effective desulphurising agents in the iron and steel industry, desulphurisation of ferrochromium by powdered reagent injection into the melt has not yet proved to be satisfactory for both technical and economic reasons.

The object of this invention is to provide a more simple and more cost effective means of desulphurising the ferrochromium from the aforesaid pre-reduction process, and also to provide some control over the final silicon content of the ferrochromium.

SUMMARY OF THE INVENTION

In accordance with this invention there is provided a method of desulphurising ferrochromium produced in a process in which a chromite ore has been highly pre-reduced by carbonaceous reductants, to a condition in which more than 80% of the chromium and more than 90% of the iron has been reduced to the metallic state the method comprising the feeding of such pre-reduced chromite ore, together with all the slag forming components, and residual carbonaceous reductant from the pre-reduction process to a heating vessel and melting same therein, in the presence of calcium oxide and carbonaceous material provided, at least in part, by the residual carbonaceous reductant from the pre-reduction process.

Further features of the invention are the strict control of the reducing conditions in the heating vessel; by the closing of the heating vessel either to exclude or to permit controlled ingress of air in balance with the addition of carbonaceous material or chromite ore thereto.

Still further features of the invention provide for the slag to contain at least 7% of calcium oxide and for the slag basicity ratio of $$\frac{\text{mass \% CaO} + \text{mass \% MgO}}{\text{mass \% } SiO_2}$$

to be at least 1.2.

The most important feature of the invention is that reducing conditions must be produced in the heating vessel, despite the fact that it is not being operated as a reduction smelter, and that control must be exercised over the reducing/oxidising potential of the slag.

By use of the invention, the silicon content of the ferrochromium may be adjusted by making provision, in the closed heating vessel, for a controlled ingress of air in order to further effect changes in the reducing/oxidising potential of the slag.

In accordance with a preferred embodiment of the invention, the ferrochromium fed to the heating vessel is the product of a solid-state or semi-fused state reduction process for chromite ores using solid carbonaceous reducing agents and in which at least 80% preferably 90% of the chromium in the ore is metallised.

DETAILED DESCRIPTION OF THE INVENTION

The invention is further described below with reference to experimental trials in which the improved desulphurisation of ferrochromium and the control over the silicon content of the alloy, by means of the method according to the invention is clearly illustrated.

A rotary kiln product from the aforementioned rotary kiln process patented by Fried. Krupp GmbH, was melted in various closed electric submerged arc furnaces. The kiln product consisted of an agglomerated mixture of finely dispersed metallic ferrochromium fraction in a non-metallic slag-forming fraction, together with approximately 5% by mass of residual coal-char (devolatised coal) this being the excess carbonaceous material remaining from the chemical reduction and energy providing reactions in the kiln.

In the Fried. Krupp GmbH patent, the residual coal-char is separated from the kiln discharge product after cooling and is then recycled to the kiln.

According to this invention, the excess coal-char is preferably retained in the kiln product which is charged to the melter, for it serves the important function of creating the reducing condition which is required in the melter for effective desulphurisation of the ferrochromium. This is well illustrated by the following results from tests carried out in the submerged arc furnaces with power ratings from 60 kvA to 2 MVA (Table 1). In tests designated A, the coal char residue was removed before charging the kiln product to the furnaces, while in tests designated B and C, all or part of the coal-char residue was retained in the kiln product.

TABLE 1

Desulphurisation results with melting of rotary kiln product

| Test no. | coal-char retained in kiln product (mass %) | CaO in slag (mass %) | slag basicity ratio | sulphur in ferrochromium (mass %) before melting | sulphur in ferrochromium (mass %) after melting |
|---|---|---|---|---|---|
| 1 A | 0 (prior art) | 7–8 | 1,2 | 0,250 | 0,130 |
| 1 B | 2,5 (this invention) | 7–8 | 1,2 | 9,250 | 0,100 |
| 1 C | 5 (this invention) | 7–8 | 1,2 | 0,250 | 0,026 |
| 2 A | 0 (prior art) | 13,5–14,5 | 1,2–1,4 | 0,250 | 0,105 |
| 2 B | 5 (this invention) | 13,5–14,5 | 1,2–1,4 | 0,250 | 0,020 |
| 3 A | 0 (prior art) | 18,5 | 1,4–1,5 | 0,250 | 0,073 |
| 3B | 5 (this invention) | 16,5 | 1,4–1,5 | 0,250 | 0.016 |

From Table 1, it is clear that not only does desulphurisation of the ferrochromium improve with increasing CaO in the slag (a fact which is well recognised by those versed in the art), but that for any one slag CaO content, desulphurisation is most effective when a reducing condition is produced in the slag by means of the coal-char in the kiln product.

Without coal-char retained in the kiln product, relatively oxidising conditions prevail in the melter atmosphere and thus in the slag. Under these conditions, with 7%–8% CaO in the slag (test 1 A) the ferrochromium was only desulphurised to approximately half of its original sulphur content; with half (2,5%) of the coal-char retained in the kiln product (test 1B), conditions in the melter became more reducing and somewhat better desulphurisation was achieved; with all of the coal-char (5%) retained in the kiln product (test 1C), conditions in the furnace became even more reducing and the sulphur content of the ferrochromium was lowered to approximately one-tenth of its original content or 0,026%. Similar results were achieved with greater contents of CaO in the slag (Test; 2A and 2B, and 3A and 3B).

It will be understood from the above that retention of the solid coal-char in the kiln product creates the reducing condition in the melter and thus in the slag for the most effective desulphurisation of the ferrochromium. The relevant metallurgical reactions are as follows:

FeS (metal)+CaO (slag)+C→CaS (slag)+Fe (metal)+CO (gas); and, $Cr_2S_3$ (metal)+3 CaO (slag)+3C→3 CaS (slag)+2Cr (metal)+3CO (gas)

It will be understood that should the coal-char residue supplied from the rotary kiln process be insufficient to create the necessary reducing conditions in the melter, additional carbonaceous material may be fed separately.

Alternatively, if the carbonaceous material from the kiln process proves to be excessive and tends to accumulate in the melter, this condition may be rectified either by allowing a controlled ingress of air into the melter or by introducing small amounts of chromite ore with which the excess carbon may react and leave the melter as gaseous carbon monoxide.

The method according to the invention can also be used to provide a means of controlling the silicon content in the ferrochromium.

As shown in Table 2, retaining all or part of the coal-char residue in the rotary kiln product charged to the melter, results in an increase in the silicon content of the ferrochromium tapped from the melter.

TABLE 2

Silicon content of ferrochromium after melting of rotary kiln product

| Test no. | coal-char contained in kiln product (mass %) | CaO in slag (mass %) | slag basicity ratio | silicon in ferrochromium (mass %) before melting | silicon in ferrochromium (mass %) after melting |
|---|---|---|---|---|---|
| 4 A | 0 (prior art) | 7–8 | 1,2 | 2,5–3,0 | 1,0 |
| 4 B | 2,5 (this invention) | 7–8 | 1,2 | 2,5–3,0 | 1,0–2,0 |
| 4 C | 5 (this invention) | 7–8 | 1,2 | 2,5–3,0 | 2,5 |

From Table 2, it is evident that, for the same slag CaO content, increasing the amount of coal-char in the melter, and thus increasing the reducing conditions, results in increased contents of silicon in the ferrochromium.

It is known also that the tendency for silica in the slag to be reduced to metallic silicon becomes less as the slag CaO content or basicity increases.

Accordingly, during the melting of a highly prereduced chromite ore product, slag reducing/oxidising potentials and slag basicities may be adjusted as part of an overall control strategy for achieving the desired composition of ferrochromium taped from the melter.

Examples of how this control strategy may be applied are:

1. If ferrochromium is required containing less than 0,03% sulphur and the silicon content should exceed 2,5%, a slag containing 7%–8% CaO should be used under a highly reducing condition generated by adding suitable carbonaceous material to the melter such as, for example, the coal-char residue in the kiln product.

2. If ferrochromium is required with less than 0,03% sulphur and with less than 2,5% silicon, the reducing potential of the slag and the activity or relative concentration of silica in the slag can be lowered to decrease the reduction of silica to silicon. Decreased reducing potential may be achieved either by lesser additions of carbonaceous material or by controlled ingress of air to the furnace or by the addition of chromite ore. At the same time, the CaO contents of the slag are increased, by appropriate flux additions, in order to compensate for its decreased reducing potential and thus its decreased desulphurising capacity. Increasing the CaO content of the slag also decreases the activity or relative concentration of silica and thus its rate of reduction to silicon in the ferrochromium.

3. If a higher sulphur content in the ferrochromium is acceptable, for example between 0,03% and 0,05%, but the silicon content should still be low, for example less than 2%, the slag can again be in a less reducing condition (as for example 2) but the increase in CaO content of 1.he slag and thus the fluxing requirement need not be as great.

The invention thus provides a method of desulphurising ferrochromium produced from chromite ores which have been highly pre-reduced with carbonaceous reductants, to a condition in which more than 80% of the chromium and more than 90% of the iron has been reduced to the metallic state and also of controlling to an extent the silicon content of the ferrochromium; in particular, but not exclusively, ferrochromium produced by carbonaceous reduction processes in a rotary kiln or rotary hearth furnace.

What I claim as new and desire to secure by Letters Patent is:

1. A method of de-sulphurizing ferrochromium produced in a process in which a chromate ore has been highly pre-reduced by carbonaceous reductants to a condition in which more than 85% of the chromium and more than 85% of the iron has been reduced to the metallic state, comprising: feeding such pre-reduced chromite ore together with slag forming components and residual carbonaceous reductant resulting from the pre-reduction process to heating vessel; and melting the same therein in the presence of calcium oxide and carbonaceous material provided, at least in part, by the residual carbonaceous reductant from the pre-reduction process.

2. A method as claimed in claim 1 wherein there is strict control of the reducing conditions in the heating vessel by control of the reduction/oxidation potential of the slag.

3. A method as claimed in claim 2 wherein control of the reduction/oxidation potential of the slag is achieved by closing the heating vessel either to exclude or to permit controlled ingress of air in balance with the addition of carbonaceous material or chromite ore thereto.

4. A method as claimed in claim 1 wherein the slag in the heating vessel contains at least 7% by mass of calcium oxide.

5. A method as claimed in claim 1 wherein the basicity ratio of the slag being defined as $$\frac{\text{mass \% CaO} + \text{mass \% MgO}}{\text{mass \% } SiO_2}$$

is at least 1.2.

6. A method as claimed in claim 1 wherein the silicon content of the ferrochromium is adjusted by the controlled ingress of air to the closed heating vessel to effect an increase or decrease in the level of the reduction/oxidation potential of the slag.

7. A method as claimed in claim 1 wherein the silicon control of the ferrochromium is adjusted by controlling the activity or relative concentration of silica in the slag.

8. A method as claimed in claim 7 wherein the control of the activity or relative concentration of silica in the slag is effected by the addition of greater or lesser amounts of CaO in the slag.

* * * * *